US005622020A

United States Patent [19]

Wood

[11] Patent Number: 5,622,020

[45] Date of Patent: Apr. 22, 1997

[54] ATTACHMENT CLIP FOR HORIZONTAL SIDING PANELS

[76] Inventor: Margaret A. Wood, 9000 Kolbrook Rd., Denton, Nebr. 68339

[21] Appl. No.: 567,270

[22] Filed: Dec. 5, 1995

[51] Int. Cl.[6] ..... E04D 1/34

[52] U.S. Cl. ..... 52/546; 52/521; 52/543; 52/549; 52/551; 52/712; 248/301

[58] Field of Search ..... 52/520, 521, 522, 52/543, 544, 545, 546, 549, 551, 712; 248/300, 301, 304, 294.1; D8/371, 372

[56] References Cited

U.S. PATENT DOCUMENTS

| | | | |
|---|---|---|---|
| D. 240,351 | 6/1976 | Generalis et al. | D8/371 |
| D. 316,956 | 5/1991 | Hoskinson et al. | D8/371 |
| 740,964 | 10/1903 | Wintsch, Jr. | 248/301 X |
| 1,219,685 | 3/1917 | Wall | 248/300 |
| 1,532,421 | 4/1925 | MacInnes et al. | 52/546 X |
| 1,940,936 | 12/1933 | Black | 52/547 |
| 2,206,560 | 7/1940 | Embury | 248/301 X |
| 2,293,744 | 8/1942 | Miles et al. . | |
| 2,395,726 | 2/1946 | Del Tufo | 52/545 X |
| 3,233,382 | 2/1966 | Graveley, Jr. . | |
| 3,261,136 | 7/1966 | Abner et al. | 52/546 X |
| 3,504,467 | 4/1970 | Hatch et al. . | |
| 3,520,099 | 7/1970 | Mattes . | |
| 3,757,483 | 9/1973 | Torbett . | |
| 3,999,348 | 12/1976 | Hicks . | |
| 4,047,349 | 9/1977 | Aguilar, Jr. | 52/551 |
| 4,186,538 | 2/1980 | Marcum, Jr. . | |
| 4,280,311 | 7/1981 | Lockard | 52/546 X |
| 4,327,528 | 5/1982 | Fritz . | |
| 4,348,849 | 9/1982 | Wollam et al. . | |
| 4,435,933 | 3/1984 | Krowl . | |
| 4,435,938 | 3/1984 | Rutkowski et al. | 52/521 |
| 4,646,501 | 3/1987 | Champagne et al. . | |
| 4,782,638 | 11/1988 | Hovind | 52/543 X |
| 4,854,101 | 8/1989 | Champagne | 52/545 X |
| 5,150,555 | 9/1992 | Wood | 52/544 |
| 5,339,608 | 8/1994 | Hollis et al. | 52/543 X |

FOREIGN PATENT DOCUMENTS

| | | | |
|---|---|---|---|
| 499696 | 11/1954 | Italy | D8/371 |

*Primary Examiner*—Carl D. Friedman
*Assistant Examiner*—Laura A. Saladino
*Attorney, Agent, or Firm*—Zarley, McKee, Thomte, Voorhees & Sease; Mark D. Frederiksen

[57] ABSTRACT

An attachment clip is formed from a generally rectangular blank of bendable material and includes a pair of depending legs bent forwardly and upwardly so as to engage the slots found in the nailing flange of standard horizontal siding panels. The clip includes a nail slot having a length greater than the length of an individual slot formed in the nailing flange of the panel, thereby permitting greater expansion and contraction of the panel on the wall to which it is attached. The clip is formed from a rectangular blank of bendable material, with a notch extending upwardly in the lower edge to form the depending legs which are journaled through individual slots in the nailing flange of the panel.

7 Claims, 3 Drawing Sheets

ATTACHMENT CLIP FOR HORIZONTAL SIDING PANELS

TECHICAL FIELD

The present invention relates generally to the attachment of horizontal siding panels to a building, and more particularly to an improved attachment clip for attaching vinyl siding to a building.

BACKGROUND OF THE INVENTION

Wood siding has been used for many years in the construction of homes and other buildings. However, wood siding has several disadvantages, including regular painting for protection, and eventual rot or other breakdown of the wood material.

In order to retain the visual effect of siding, yet overcome the problems associated with wood, alternative materials such as metal and plastics have been utilized to simulate wood siding. Metal siding is typically formed of aluminum or steel, while plastic siding is conventionally formed from polyvinyl chloride, more commonly referred to as vinyl. In both types of siding, the bottom margin of each panel is bent inwardly and then upwardly to form a longitudinal channel flange with an upstanding inner leg, and the top portion of each panel is formed to provide an outwardly and downwardly projecting longitudinal lip corresponding to the channel flange of an adjacent panel. The panels are conventionally secured to a wall along their top portions, above the projecting longitudinal lip, utilizing fasteners driven through a nailing flange along the top of each panel.

One problem that is common with both metal and vinyl siding is in the expansion and contraction of the siding with changes in temperature. Because of this expansion and contraction, it has been common to attach the siding utilizing longitudinal nail slots provided in the nailing flange of each panel. The nails were then driven into the nail slots a sufficient distance to support the siding, but not far enough to grip the siding to prevent slidable movement along the nail slots.

In order to avoid splicing or overlapping horizontal lengths of siding, it is becoming increasingly common to provide longer lengths of siding which extend horizontally across an entire wall surface. These longer lengths of siding have posed problems in attachment because of the additional expansion and contraction which occurs. Conventional siding nailing flanges have nail slots approximately ⅛ inch in width and approximately 1 and ⅛ inch in length. Thus, the maximum amount of expansion or contraction is approximately 9/16 of an inch in either direction. With the use of long lengths of siding, this distance is not sufficient, and the siding can "ripple" or bulge where fastened during extreme expansion or contraction.

Attempts to deal with this problem have resulted in failure. Increasing the length of the nail slots in the nailing flange results in a narrow support strip above the nail slot, which is insufficient to support the siding, and causes rippling and bulging. Attempts to strengthen the nailing flange to permit longer nail slot lengths have also failed. An increase in the thickness of the nailing flange causes the nailing flange to expand at a different rate than the remaining portions of the siding panel, again causing rippling and/or bulging.

Another problem with vinyl siding is the low structural strength of the nailing flange when a nail is inserted through the nail slot. Because of the small cross-section of the nail, and the narrow width of the material between the nail slot and upper edge of the panel, the vinyl material will not support a great amount of weight, and is easily ripped upon the application of a downward dynamic force on the panel. Thus, application of vinyl siding to manufactured homes, which are transported over the road, has a significant problem with loss of vinyl siding during transit.

SUMMARY OF THE INVENTION

It is therefore a general object of the present invention to provide an improved attachment clip for horizontal siding panels.

A further object is to provide an improved attachment clip which permits greater expansion and contraction lengths than conventional siding nail slots.

Yet another object is to provide an improved attachment clip which supports the panel and provides a greater strength to the nailing flange of the panel.

A further object of the present invention is to provide an improved siding attachment clip which is economical to manufacture and simple to use.

These and other objects will be apparent to those skilled in the art.

The attachment clip of the present invention is formed from a generally rectangular blank of bendable material and includes a pair of depending legs bent forwardly and upwardly so as to engage the slots found in the nailing flange of standard horizontal siding panels. The clip includes a nail slot having a length greater than the length of an individual slot formed in the nailing flange of the panel, thereby permitting greater expansion and contraction of the panel on the wall to which it is attached. The clip is formed from a rectangular blank of bendable material, with a notch extending upwardly in the lower edge to form the depending legs which are journaled through individual slots in the nailing flange of the panel.

DESCRIPTIONOF THE PREFERRRED EMBODIMENT

Figure 1:
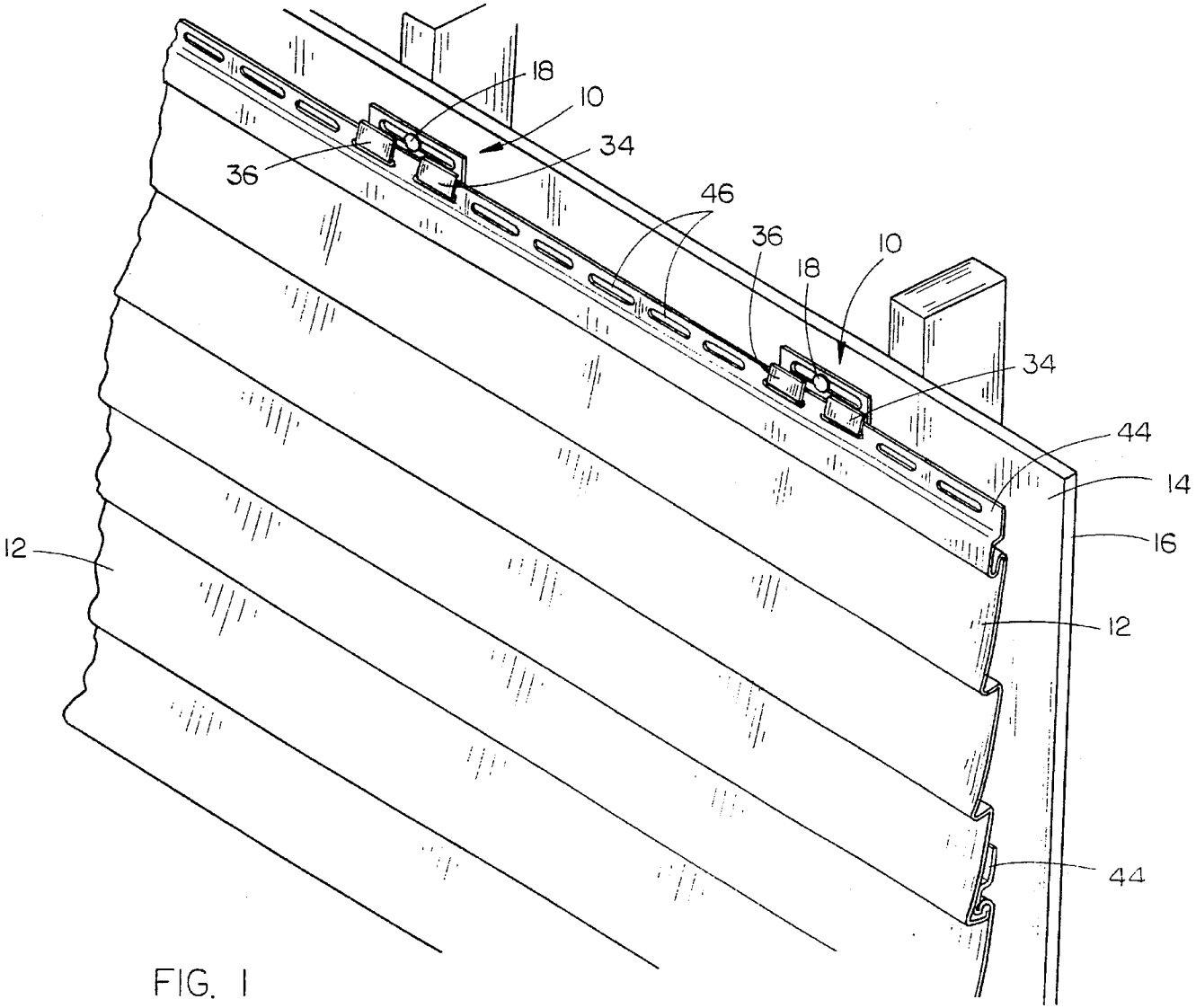
FIG. 1 is a perspective view of siding panels attached to a wall utilizing the clip of the present invention.

Referring now to the drawings, in which similar or corresponding parts are identified with the same reference numeral and more particularly to FIG. 1, the attachment clip of the present invention is designated generally at 10 and is shown retaining a horizontal siding panel 12 in position on the front surface 14 of a wall 16. Preferably, each attachment clip 10 is mounted with a nail 18, or other fastener, directly into wall 16.

Figure 2:
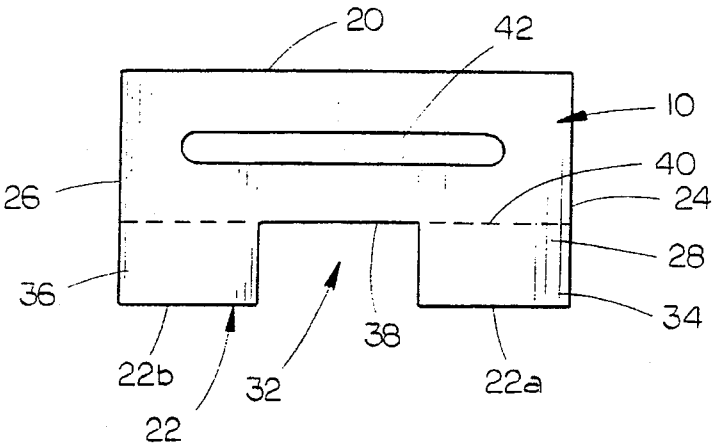
FIG. 2 is a front elevational view of the clip 10 before bending of the clip into an operable position.
Figure 3:
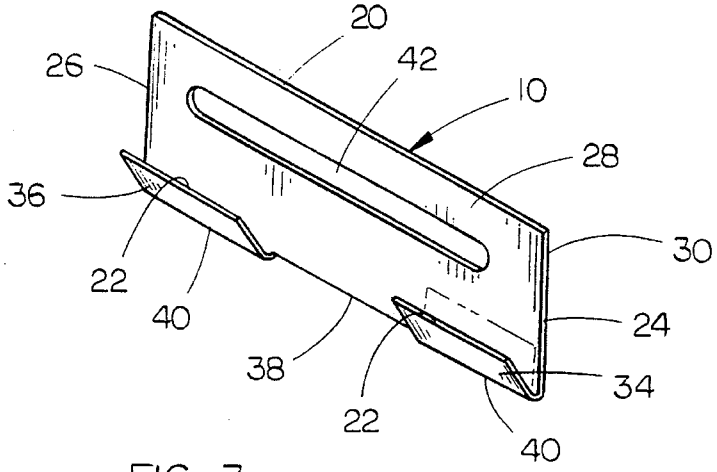
FIG. 3 is an enlarged perspective view of a clip of the present invention.

Referring now to FIGS. 2 and 3, attachment clip 10 is formed from a thin rectangular sheet of metal having an upper edge 20, lower edge 22, opposing side edges 24 and 26, and forward and rearward faces 28 and 30 respectively. A notch 32 is formed in lower edge 22 intermediate side edges 24 and 26, and extends upwardly to form depending legs 34 and 36 on opposite sides of notch 32. The lower edge of clip 10 within notch 32 is designated at 38, while the lower edge of clip 10 on legs 34 and 36 is designated by numerals 22*a* and 22*b* respectively.

As shown in FIG. 3, legs 34 and 36 are bent upwardly and forwardly along a line 40 substantially aligned with notch edge 38 (also shown in FIG. 2). An elongated slot 42 is formed generally midway between clip upper edge 20 and notch edge 38, and extends less than the entire distance across the width of clip 10. Slot 42 is sized to permit nail 18 to be journaled therethrough and permit slidable movement of clip 10 with the nail in place.

Figure 4:
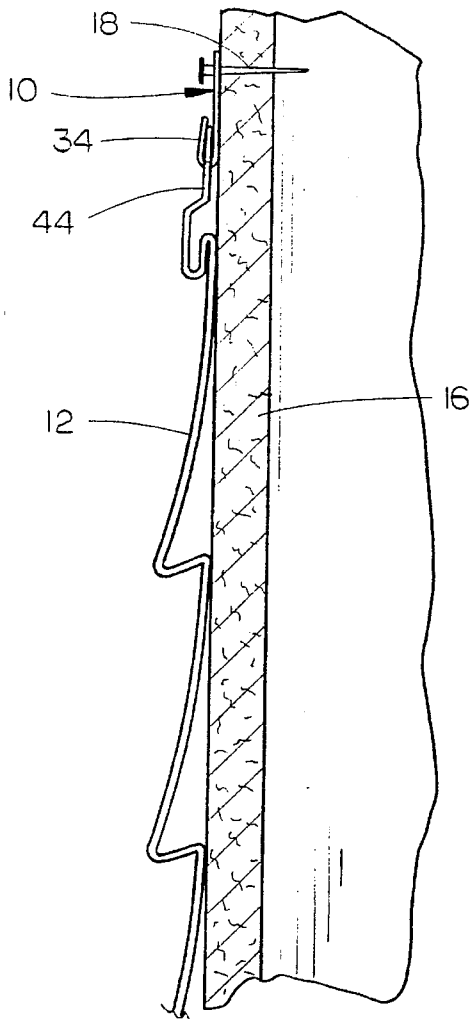
FIG. 4 is a vertical sectional view through a wall showing siding attached to the wall using the clip of the present invention.

Referring once again to FIG. 1, each siding panel 12 includes a nailing flange 44 projecting upwardly to form the upper edge of the siding panels 12. The flange 44 has a plurality of horizontally oriented and aligned slots 46 designed to receive a nail or other fastener. Conventional vinyl siding has standard sized slots 46 having a length of approximately 1 and ⅛ inches and a width of approximately ⅛ inch. The slots are uniformly spaced apart approximately 9/16 of an inch. The width of legs 34 and 36 on each clip 10 is less than the length of slots 46, to permit journaling of clip legs 34 and 36 through adjacent nail slots 46 in siding panels 12. The length of clip slot 42 is greater than the length of nail slots 46, to permit a greater amount of expansion and contraction of the siding panel 12 without causing rippling or bulging of the panel, as shown in FIG. 4.

As shown in FIG. 3, clip 10 is preferably formed of a metal material without memory, such that legs 34 and 36 will maintain the bent position shown in FIG. 3 for simple insertion through the nail slots 46 in a siding panel 12 (see FIG. 1 ). Once installed, as shown in FIG. 4, legs 34 and 36 may then be bent rearwardly towards the forward surface 28 of clip 10 to thereby clamp and grip the siding panel 12 (see FIG. 4).

Figure 5:
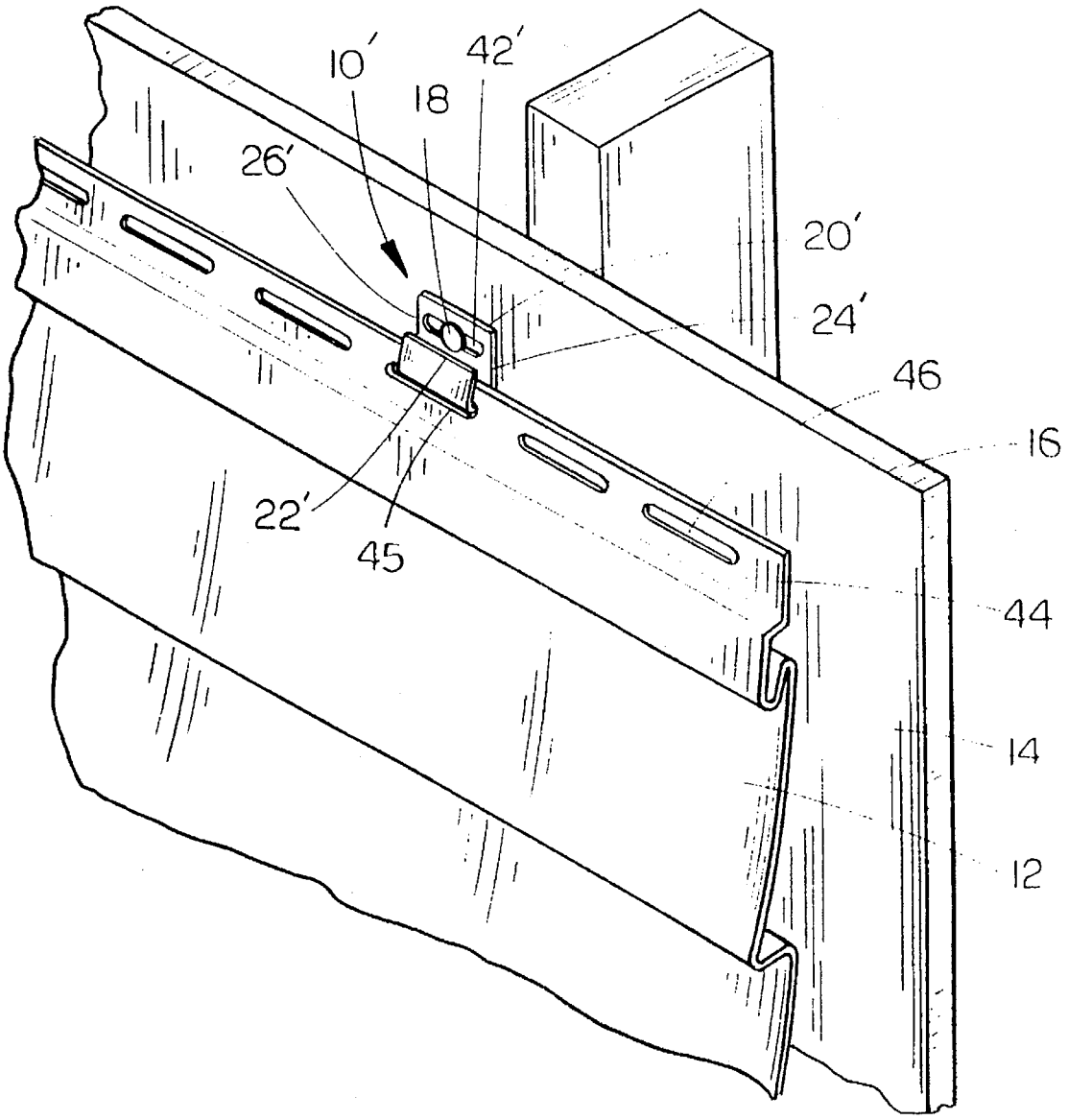
FIG. 5 is a perspective view of a second embodiment of the attachment clip connecting a vinyl panel to a wall.

Referring now to FIG. 5, a second embodiment of the attachment clip is designated generally at 10' and is shown retaining siding panel 12 in position on the front surface 14 of wall 16. Preferably, attachment clip 10' is mounted with a nail 18, or other fastener, directly into wall 16.

Attachment clip 10' is preferably formed from a thin rectangular sheet of metal having an upper edge 20', lower edge 22' and opposing side edges 24' and 26'. The lower end of clip 10 is bent upwardly to form a generally J-shaped clip which may be inserted through a nail slot 46 in the nailing flange 44 of panel 12. Preferably, the width of clip 10' is slightly less than the length of slot 46, so as to substantially fill the length of the slot and thereby spread the weight of panel 12 across the entire width of clip 10'.

An elongated slot 42' is formed parallel to and spaced below the upper edge 20' of clip 10' and extends less than the entire distance across the width of clip 10'. Slot 42' is sized to permit nail 18 to be journaled therethrough and permit slidable movement of clip 10' with the nail in place.

It has been found that the strength of the metal clip 10' is much greater than that of the vinyl nailing flange 44 of siding panel 12, such that the vinyl siding panel 12 will be retained in position against much greater dynamic forces than if a nail alone is inserted through nail slots 46 of the panel 12.

Whereas the invention has been shown and described in connection with the preferred embodiment thereof, many modifications, substitutions and additions may be made which are within the intended broad scope of the appended claims.

I claim:

1. In combination:

an elongated, extended len..qth horizontal siding panel having a nailing flange formed continuously along an upper edge;

said nailing flange having a plurality of uniform length, uniformly spaced apart slots aligned parallel to the upper edge and spaced a predetermined distance therefrom; and at least one attachment clip connected to the nailing flange to support that panel on a wall;

said clip including at least two legs, each said leg journaled through one of said plurality of nailing flange slots; and said clip having a nail slot therein extending parallel to the nailing flange slots and having a length greater than each nailing flange slot.

2. The combination of claim 1, wherein said clip is formed from a generally rectangular blank of bendable material having no memory.

3. The combination of claim 2, wherein said blank includes an upper edge, lower edge, opposing side edges and forward and rearward faces, and wherein a notch extends upwardly in the lower edge to form the legs on opposite sides of the notch, said notch having an upper edge extending between the legs and parallel to the nail slot.

4. The combination of claim 3, wherein the distance between the clip notch upper edge and the nail slot is greater than the distance between the nailing flange slots and the upper edge of the nailing flange.

5. In combination:

an elongated, extended-lenqth horizontal siding panel having a nailing flange formed continuously along an upper edge;

said nailing flange having a plurality of uniform length, uniformly spaced apart slots aligned parallel to the upper edge and spaced a predetermined distance therefrom; and at least one attachment clip connected to the nailing flange to support that panel on a wall;

said clip including at least one leg journaled through one of said nailing flange slots;

said clip having a nail slot therein extending parallel to the nailing flange slots, wherein said clip leg has a width substantially filling a length of the nailing flange slot, such that the clip will move with the siding panel as the siding panel expands and contracts in length.

6. The combination of claim 5, wherein said clip is formed from a generally rectangular blank of bendable material having no memory.

7. The combination of claim 6, wherein said siding panel is formed of a vinyl material, and the clip is formed of a metal material.

* * * * *